US011840853B1

(12) United States Patent
Arteaga

(10) Patent No.: US 11,840,853 B1
(45) Date of Patent: Dec. 12, 2023

(54) BRACKET FOR USE WITH CEMENT BOARD SIDING

(71) Applicant: Eric Arteaga, Meadow Vista, CA (US)

(72) Inventor: Eric Arteaga, Meadow Vista, CA (US)

( * ) Notice: Subject to any disclaimer, the term of this patent is extended or adjusted under 35 U.S.C. 154(b) by 0 days.

(21) Appl. No.: 17/588,604

(22) Filed: Jan. 31, 2022

Related U.S. Application Data

(60) Provisional application No. 63/143,106, filed on Jan. 29, 2021.

(51) Int. Cl.
*E04G 23/02* (2006.01)
*E04F 13/14* (2006.01)

(52) U.S. Cl.
CPC ..... *E04G 23/0296* (2013.01); *E04F 13/141* (2013.01)

(58) Field of Classification Search
CPC ..... E04G 23/0203; E04G 23/0214; E04G 23/0296; E04F 13/141; E04F 13/0801; E04F 13/0821; E04F 13/16; E04F 13/21; E04F 13/22; E04F 13/26; E04F 19/02; E04F 19/022; E04F 19/062; E04F 2201/0511; E04F 2201/0517
USPC ..... 52/461, 543, 544, 545, 546, 547
See application file for complete search history.

(56) References Cited

U.S. PATENT DOCUMENTS 1,463,482 A * 7/1923 Mountford ..... E04D 1/29 52/547
1,586,700 A * 6/1926 Reinhardt ..... E04B 2/709 52/459
1,642,088 A * 9/1927 Scarff ..... E04D 5/142 52/748.1
2,495,303 A * 1/1950 Wisniewski ..... E04F 13/0864 52/468
D339,875 S * 9/1993 Schutz ..... D8/394
D341,667 S * 11/1993 Schultz ..... D25/139
5,794,396 A * 8/1998 Gibbs ..... E04D 1/365 52/518
6,052,961 A * 4/2000 Gibbs ..... E04D 1/365 52/518
8,196,367 B2 * 6/2012 De Bray ..... E04F 13/0864 52/549
8,875,463 B2 * 11/2014 Plagemann ..... E04F 13/0892 52/553
(Continued)

FOREIGN PATENT DOCUMENTS

FR 2924139 A1 * 5/2009 ..... E04F 13/141

*Primary Examiner* — Ryan D Kwiecinski
(74) *Attorney, Agent, or Firm* — Larry D. Johnson

(57) ABSTRACT

A bracket for use with cement board siding may be used to fill in a gap that may have formed over time between the ends of adjacent boards that have been installed on the side of a building structure. In some implementations, the bracket comprises an elongated rectangular plate having a top edge, bottom edge, and rear surface. The rear surface may include a spanning feature that extends outwardly from the rear surface such that when the bracket is installed into a gap between adjacent siding boards, the ends of the spanning feature mechanically contact the ends of those boards. The bottom edge may include a return portion to engage the bottom edges of adjacent siding boards when the bracket has been installed. The top edge may extend upwards beneath one or more siding boards located above the gap in the boards.

6 Claims, 4 Drawing Sheets

(56) References Cited

U.S. PATENT DOCUMENTS

| | | | | |
|---|---|---|---|---|
| 2010/0132295 | A1* | 6/2010 | Bootier | E04F 13/0841 52/582.1 |
| 2014/0053491 | A1* | 2/2014 | Plagemann | E04F 13/0864 52/506.06 |

* cited by examiner

BRACKET FOR USE WITH CEMENT BOARD SIDING

CROSS REFERENCE TO RELATED APPLICATIONS

The present application claims the benefit of the filing date of U.S. Provisional Patent Application Ser. No. 63/143,106, filed Jan. 29, 2021. The foregoing application is incorporated by reference in its entirety as if fully set forth herein.

TECHNICAL FIELD

This written description relates generally to construction materials and associated hardware, and more particularly to an improved bracket for use with cement board siding.

SUMMARY

Described below is a bracket for use with cement board siding (such as that commonly sold under the brand name Hardie Board). In some implementations, the bracket may be used to fill in a gap that may have formed over time between the ends of adjacent boards that have been installed on the side of a building structure.

In some implementations, the bracket comprises an elongated rectangular plate having a top edge, bottom edge, and rear surface. In some implementations, the rear surface includes a spanning feature that extends outwardly from the rear surface such that when the bracket is installed into a gap between adjacent siding boards, the ends of the spanning feature mechanically contact the ends of those boards. In some implementations, the bottom edge includes a return portion to engage the bottom edges of adjacent siding boards when the bracket has been installed. In some implementations, the top edge extends upwards beneath one or more siding boards located above the gap in the boards.

Particular embodiments of the subject matter described in this specification can be implemented so as to realize one or more of the following advantages.

In some implementations, the bracket provides structural support to adjacent boards on the side of a building structure by engaging the ends of those boards.

In some implementations, the bracket provides beautification to the siding of a building structure by filling in the gap that may have formed between the ends of adjacent boards.

In some implementations, the bracket provides fire-resistance to a building structure by sealing the gap between the ends of adjacent boards and covering the otherwise exposed surface of the building structure beneath the boards.

The details of one or more embodiments of the subject matter described in this specification are set forth in the accompanying drawings and the description below. Other features, aspects, and advantages of the subject matter will become apparent from the description, the drawings, and the claims.

Those skilled in the art will appreciate that the conception upon which this disclosure is based readily may be utilized as a basis for the designing of other structures, methods and systems that include one or more of the various features described below.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

DETAILED DESCRIPTION

Figure 1:
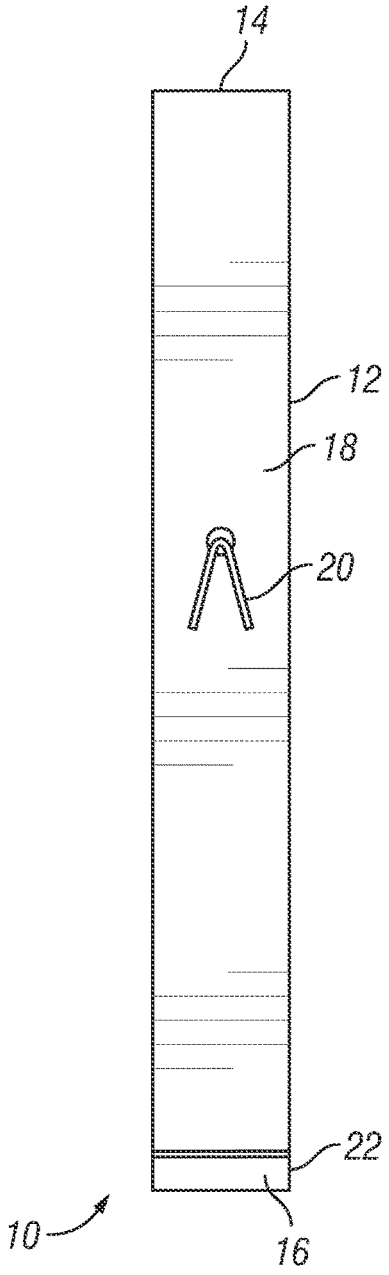
FIG. 1 is a rear elevation view of one implementation of a bracket for use with cement board siding.

Referring to FIGS. 1 through 5, wherein like reference numerals refer to like components in the various views, there is illustrated therein a bracket for use with cement board siding, generally denominated 10 herein.

FIG. 1 is a rear elevation view of one implementation of a bracket 10 for use with cement board siding. In some implementations, the bracket comprises an elongated rectangular plate 12 having a top edge 14, bottom edge 16, and rear surface 18. In some implementations, the rear surface includes a spanning feature 20 such as an inverted V-shaped element that extends outwardly from the rear surface 18 such that when the bracket is installed into a gap that may have formed between adjacent siding boards, the ends of the spanning feature 20 (in this example, the ends of the arms of the "V") mechanically contact the ends of those boards. In some implementations, the spanning feature 20 is spot welded to the rear surface 18. In some implementations, the spanning feature is flexible and can be adjusted in spanning width to accommodate various gap sizes that may be found between adjacent boards.

In some implementations, the bottom edge 16 includes a return portion or "hook" 22 to engage the bottom edges of adjacent siding boards when the bracket has been installed. In some implementations, the top edge 14 of the strap extends upwards beneath one or more siding boards located above the gap in the boards.

Figure 2:
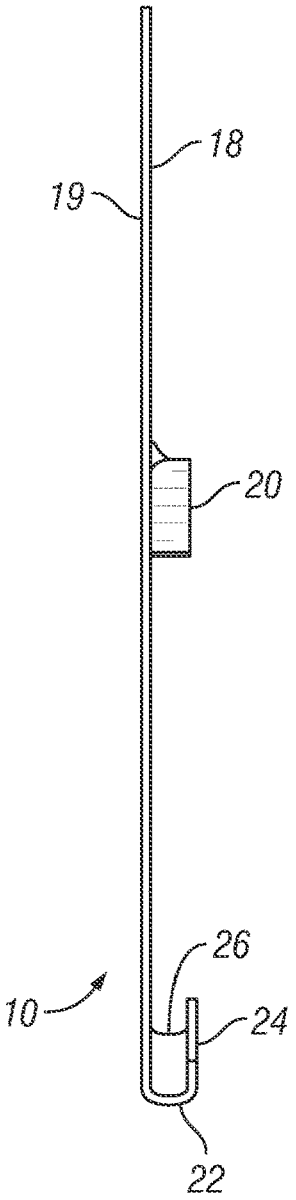
FIG. 2 is a side elevation view thereof.

FIG. 2 is a side elevation view of one implementation of a bracket 10, illustrating rear surface 18, front surface 19, spanning feature 20, and return portion 22. In some implementations, spanning feature 20 extends outwardly from the rear surface 18 a distance that is preferably less than or equal to the thickness of the siding boards into which the bracket is being installed, to avoid interference with the surface of the building structure beneath the boards. In some implementations, return portion 22 includes an inside lip 24 defining a gap 26. In some implementations, the width of gap 26 is preferably substantially the same size as the thickness of the siding boards into which the bracket is being installed, such that the return portion may engage and capture the bottom edges of the adjacent siding boards.

Figure 3:
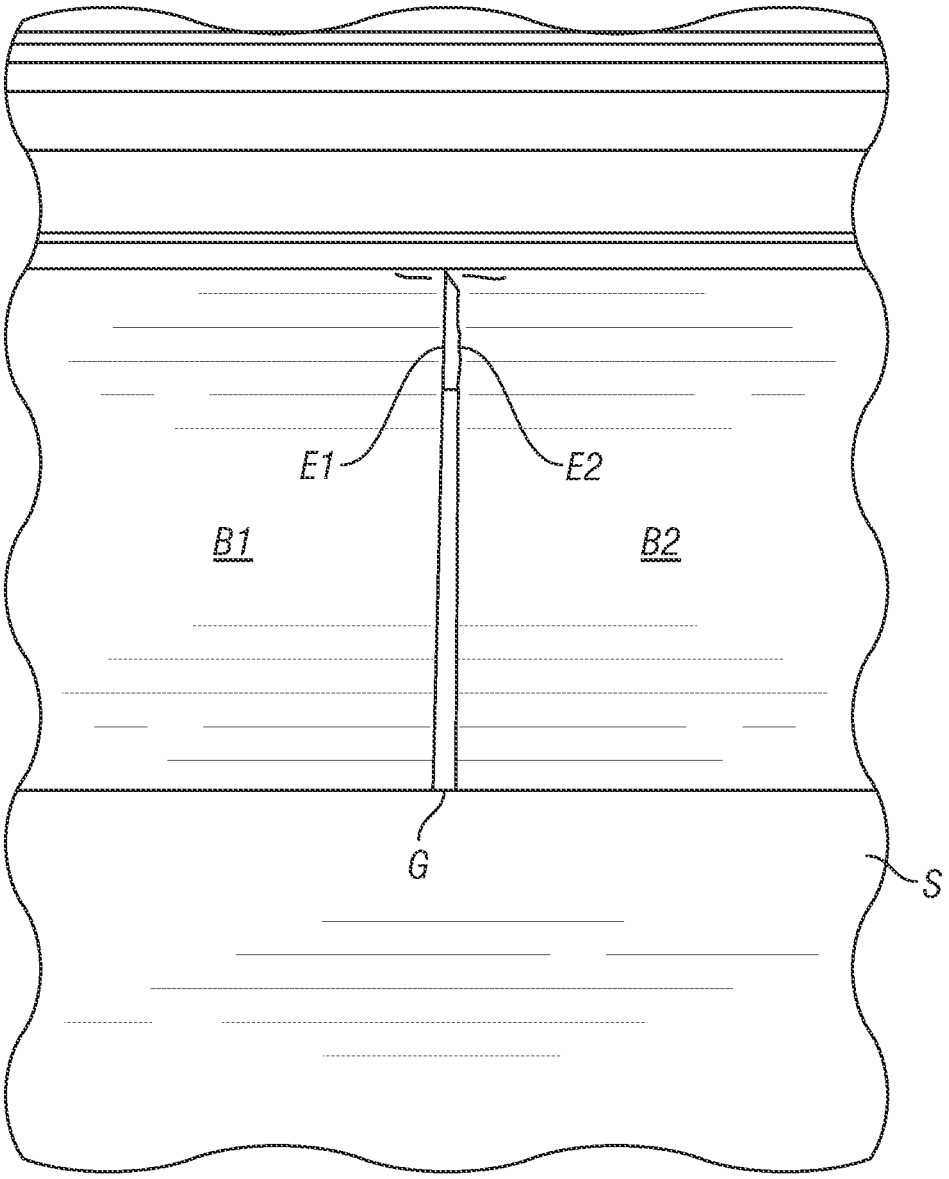
FIG. 3 is a front elevation view of a gap of the type that may have formed over time between the ends of adjacent boards on the side of a building structure.

FIG. 3 is a front elevation view of a gap G of the type that may have formed over time between the ends E1 and E2 of adjacent boards B1 and B2 on the side of a building structure S.

Figure 4:
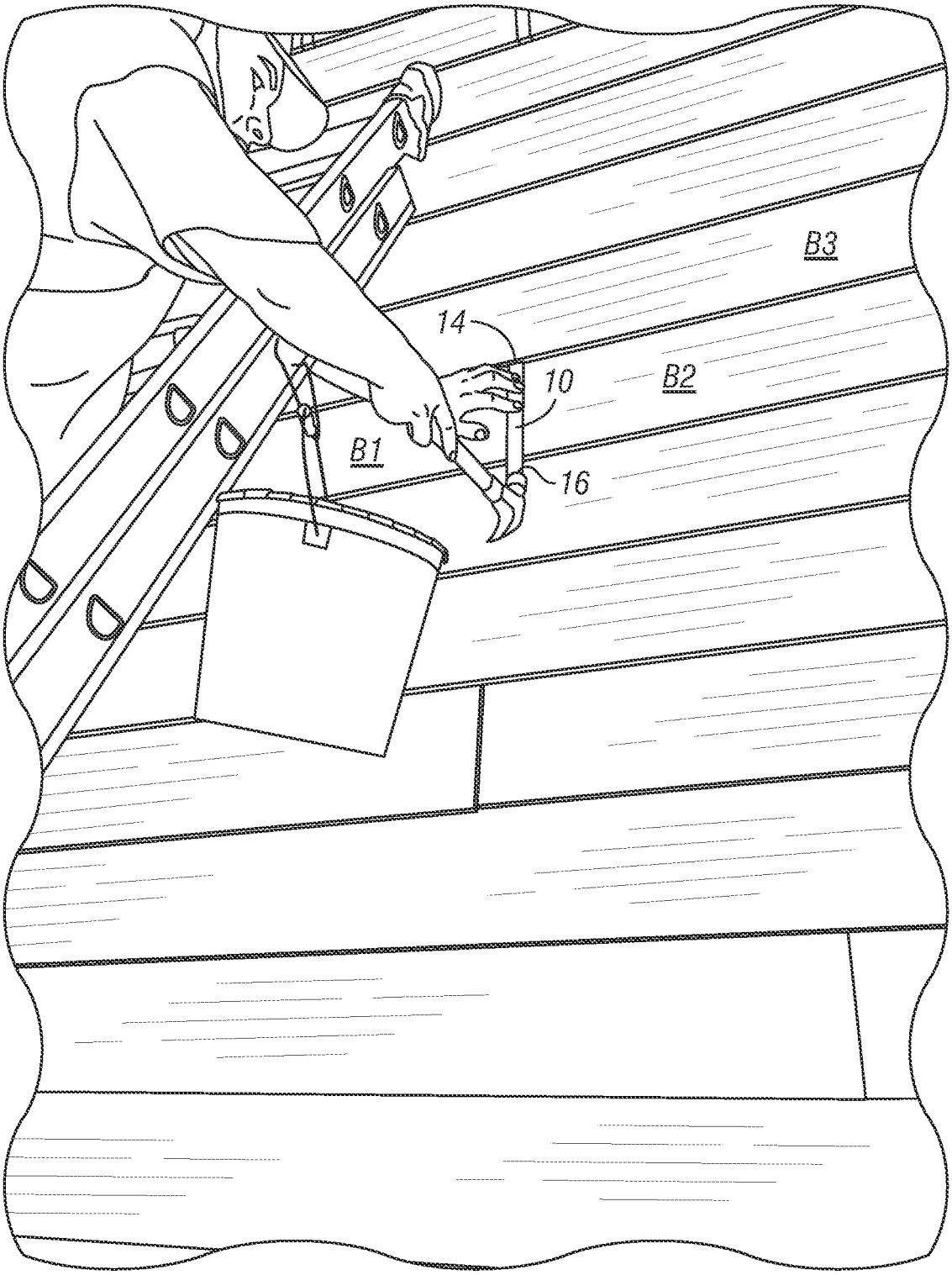
FIG. 4 is a view of one implementation of a bracket being installed into a gap that has formed between the ends of adjacent boards on the side of a building structure.

FIG. 4 is a view of one implementation of a bracket 10 being installed into a gap that had formed between the ends of adjacent boards B1 and B2 on the side of a building structure. In some implementations, the bracket is installed by placing the rear surface of the bracket over the gap such that the spanning feature fits into the bottom portion of the gap, and the ends of the spanning feature engage the ends of the adjacent boards B1 and B2. The bracket top edge 14 is positioned beneath the bottom of the siding board B3 that lies above the boards B1 and B2, and the bracket bottom edge 16 is driven upward (as by impacting with a hammer or other tool) such that the top edge is driven underneath siding board B3 and is mechanically engaged there; the spanning feature is driven into the gap between siding boards B1 and B2 and is mechanically engaged there; and the bracket return portion is driven underneath the bottom edges of the siding boards B1 and B2 and is mechanically engaged there.

Figure 5:
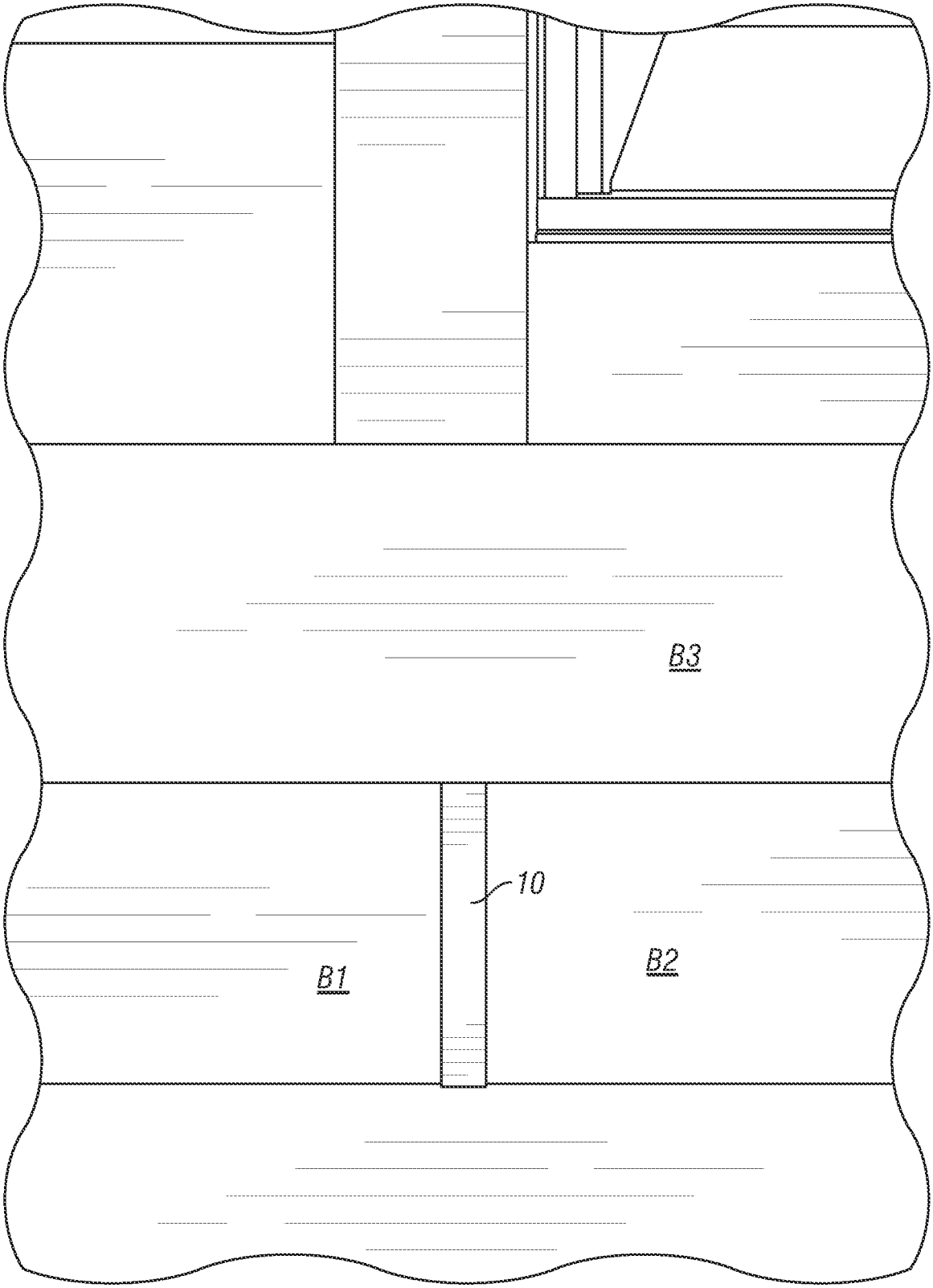
FIG. 5 is a front elevation view of one implementation of a bracket as installed between the ends of adjacent boards and painted to match the color of the surrounding boards.

FIG. 5 is a front elevation view of one implementation of a bracket as installed between the ends of adjacent boards and painted to match the color of the surrounding boards. In this view, bracket top edge 14 is not visible and rests behind siding board B3; spanning feature 20 is not visible and rests between boards B1 and B2; and bottom edge return 22 is not visible and rests beneath and behind the bottom edges of siding boards B1 and B2. This results in three points of contact between the bracket and adjoining/surrounding siding boards, providing not only aesthetic coverage of a gap between boards, but structural support to adjacent boards, and fire-resistance to the building structure itself by covering the otherwise exposed surface beneath the boards.

The bracket may be constructed in any size to accommodate the dimensions of the associated siding boards. In the example implementation, the bracket is 8.422 inches long and 1.125 inches wide. A spanning feature may be positioned on the rear surface 3.625 inches from the top edge, and may consist of an inverted "V" having an internal angle of 43 degrees, extending outwardly from the rear surface 0.270 inches, with the arms of the V 0.625 inches in length. The bottom edge of the bracket may include a return having a gap of 0.270 inches.

The bracket may be constructed from any appropriate material, and in the example implementation is constructed of sheet metal such as 18 gauge cold rolled steel. Other materials may also be used, such as aluminum or plastic, for example. The material used is preferably paintable to enable the bracket to be painted the same color as the surrounding boards.

In some implementations, the bracket bridges the gap between adjacent boards. Cement fiber is not a product that can be nailed down and caulking the gap between boards is only temporary at best, as it ultimately degrades and cracks, and provides no structural support. The bracket can be primed and painted to any finish color. The bracket provides structural support, beautification, and fire-resistance due to it sealing the gap between boards.

In other implementations, the bracket may be used to frame a vent or other feature on the side of a building structure.

Accordingly, the bracket may be characterized as a bracket for use with cement board siding to fill in a gap that may have formed between the ends of adjacent boards on the side of a building structure, the bracket comprising an elongated rectangular plate having a top edge, bottom edge, and rear surface; the rear surface including a spanning feature that extends outwardly from the rear surface such that when the bracket is installed into a gap between adjacent siding boards, ends of the spanning feature mechanically engage the ends of those boards.

The bracket may be further characterized as wherein the spanning feature comprises an inverted V-shaped element; wherein the spanning feature is flexible and can be adjusted in spanning width to accommodate various gap sizes that may be found between adjacent boards; wherein the spanning feature extends outwardly from the rear surface a distance that is less than or equal to the thickness of the siding boards into which the bracket is being installed; wherein the bottom edge includes a return portion to engage bottom edges of adjacent siding boards when the bracket has been installed; wherein the return portion includes an inside lip defining a gap; and wherein the gap has a width substantially the same size as the thickness of the siding boards into which the bracket is being installed.

A method for repairing a gap that has formed between ends of adjacent siding boards on a side of a building structure may be characterized as comprising providing an elongated rectangular plate having a top edge, bottom edge, and rear surface; the rear surface including a spanning feature that extends outwardly from the rear surface, and the bottom edge including a return portion; placing the rear surface of the plate over a gap such that the spanning feature fits into a bottom portion of the gap, and ends of the spanning feature engage the ends of the adjacent siding boards; positioning the top edge of the plate beneath a bottom of a siding board that lies above the adjacent siding boards; and driving the bottom edge of the plate upward such that the top edge of the plate is driven underneath the siding board that lies above the adjacent siding boards and is mechanically engaged there; the spanning feature is driven into the gap between the adjacent siding boards and is mechanically engaged there; and the return portion is driven underneath bottom edges of the adjacent siding boards and is mechanically engaged there.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A bracket for use with cement board siding to fill in a gap that may have formed between the ends of adjacent boards on the side of a building structure, the bracket comprising:

an elongated rectangular plate having a top edge, bottom edge, and rear surface; the rear surface including an inverted V-shaped spanning feature having a pair of arms that extends outwardly from the rear surface such that when the bracket is installed into a gap between adjacent siding boards, the ends of the arms of the spanning feature mechanically engage the ends of those boards, wherein the spanning feature is flexible and can be adjusted in spanning width to accommodate various gap sizes that may be found between adjacent boards.

2. The bracket of claim 1 wherein the bottom edge includes a return portion to engage bottom edges of adjacent siding boards when the bracket has been installed.

3. The bracket of claim 2 wherein the return portion includes an inside lip defining a gap.

4. A method for repairing a gap that has formed between ends of adjacent siding boards on a side of a building structure, the method comprising:

providing an elongated rectangular plate having a top edge, bottom edge, and rear surface; the rear surface including an inverted V-shaped spanning feature having a pair of arms that extends outwardly from the rear surface, and the bottom edge including a return portion;

placing the rear surface of the plate over a gap such that the spanning feature fits into a bottom portion of the gap, and the ends of the arms of the spanning feature engage the ends of the adjacent siding boards;

positioning the top edge of the plate beneath a bottom of a siding board that lies above the adjacent siding boards; and driving the bottom edge of the plate upward such that the top edge of the plate is driven underneath the siding board that lies above the adjacent siding boards and is mechanically engaged there; the spanning feature is driven into the gap between the adjacent siding boards and is mechanically engaged there; and the return portion is driven underneath bottom edges of the adjacent siding boards and is mechanically engaged there.

5. A bracket for use with cement board siding to fill in a gap that may have formed between the ends of adjacent boards on the side of a building structure, the bracket comprising:

an elongated rectangular plate having a top edge, bottom edge, and rear surface; the rear surface including an inverted V-shaped spanning feature having a pair of arms that extends outwardly from the rear surface such that when the bracket is installed into a gap between adjacent siding boards, the ends of the arms of the spanning feature mechanically engage the ends of those boards, wherein the bottom edge includes a return portion to engage bottom edges of adjacent siding boards when the bracket has been installed, and the return portion includes an inside lip defining a gap.

6. The bracket of claim 5 wherein the spanning feature is flexible and can be adjusted in spanning width to accommodate various gap sizes that may be found between adjacent boards.

* * * * *